US005885028A

United States Patent [19]

Blanchard et al.

[11] Patent Number: 5,885,028

[45] Date of Patent: Mar. 23, 1999

[54] FLOATING SYSTEMS AND METHOD FOR STORING PRODUCED FLUIDS RECOVERED FROM OIL AND GAS WELLS

[75] Inventors: Conrad J. Blanchard, Belle Chasse; Frank L. Anastasio, Covington, both of La.

[73] Assignee: American Oilfield Divers, Inc., Houston, Tex.

[21] Appl. No.: 762,720

[22] Filed: Dec. 10, 1996

[51] Int. Cl.[6] ..... E02D 27/38; B63B 35/02

[52] U.S. Cl. ..... 405/210; 114/74 R; 114/264; 405/205

[58] Field of Search ..... 405/210, 224, 405/205, 204, 206, 207, 208; 166/359, 352; 114/264, 265

[56] References Cited

U.S. PATENT DOCUMENTS

| | | | |
|---|---|---|---|
| 3,454,083 | 7/1969 | Brooks | 166/359 X |
| 3,535,883 | 10/1970 | Manning | 405/224 X |
| 3,552,131 | 1/1971 | Mott et al. | 405/224 X |
| 3,572,278 | 3/1971 | Knapp et al. | 405/210 X |
| 3,602,302 | 8/1971 | Kluth | 166/352 X |
| 3,782,458 | 1/1974 | Slack | 166/359 X |
| 4,031,919 | 6/1977 | Ortloff et al. | 405/224 X |
| 4,320,545 | 3/1982 | Pomonik | 405/224 X |
| 4,367,055 | 1/1983 | Gentry et al. | 166/359 X |
| 4,640,647 | 2/1987 | Blair et al. . | |
| 4,674,918 | 6/1987 | Kalpins | 405/224 |
| 4,702,648 | 10/1987 | Stageboe et al. | 405/224 |
| 4,710,061 | 12/1987 | Blair et al. . | |
| 4,818,146 | 4/1989 | Fontenot . | |
| 5,117,914 | 6/1992 | Blandford | 166/352 X |
| 5,498,107 | 3/1996 | Schatzle Jr. . | |

OTHER PUBLICATIONS

J. E. Hunteman, et al., "Concrete Gravity Platform in Shallow Offshore Louisiana Water," paper presented at the 11th Annual Offshore Technology Conference, Houston, Texas, Apr. 30–May 3, 1979.

F. L. Anastasia, Jr., "Concrete Tank, Steel Platform Marriage Sets Development Scheme," *Offshore,* Dec. 1991, pp. 47–48.

C. Blanchard, conceptual proposal in letter of Nov. 27, 1995 and accompanying sketch.

"Concrete Barges," Production Management Structural Systems, Inc., New Orleans, Louisiana.

F. L. Anastasio, Jr., "Concrete–Steel Platforms Offer Shallow Water Option," *Ocean Industry,* May 1989.

*Primary Examiner*—Dennis L. Taylor
*Attorney, Agent, or Firm*—Browning Bushman

[57] ABSTRACT

A storage facility for use in temporarily storing produced fluids, e.g., crude oil from oil and gas wells, comprising a floating, concrete barge having at least one storage compartment, the barge being positioned in a preselected location in a body of water, the concrete barge preferably being of double-wall construction, having a plurality of storage compartments, and having no exposed structural or reinforcing steel subject to attack by weather and/or sea elements.

10 Claims, 2 Drawing Sheets

FLOATING SYSTEMS AND METHOD FOR STORING PRODUCED FLUIDS RECOVERED FROM OIL AND GAS WELLS

BACKGROUND OF THE INVENTION

1. Field of the Invention

The present invention relates to floating storage facilities for collecting and temporarily storing produced fluids from oil and gas wells. More particularly, the present invention relates to a system including a floating storage barge that can be selectively positioned in a body of water at a preselected location.

2. Description of the Prior Art

Large amounts of crude oil and other hydrocarbon liquids are produced from subsea and other underwater formations. While in some cases it is economically feasible to transmit the produced fluids to storage facilities on land via pipelines, such pipelines are expensive, pose environmental concerns, and are often times not practical. Nonetheless, produced fluids from oil and gas wells at such locations must be temporarily stored lest production from the wells be halted.

It is known to position tankers and other typical water-borne or floatable storage and transporting vessels at preselected offshore locations, the tankers either being held in a fixed position by means of anchors or the like, or else tethered to a calm buoy that is fixed at a preselected position.

The use of tankers and other such conventional steel storage and/or transfer vessels for offshore, or at least on-water, storage of produced fluids is expensive, in the case of vessels, because of the inherent expense of the vessels. Furthermore, these conventional steel vessels and storage systems are subject to rust and corrosion, which necessitates constant maintenance, particularly when the vessels or floating storage systems are disposed in saltwater environments. A significant problem in using steel tankers as offshore storage facilities lies in the fact that the tankers are subject to mechanical fatigue limiting their effective life to about 10 to 15 years.

SUMMARY OF THE INVENTION

It is therefore an object of the present invention to provide an improved storage system, including a floating, concrete barge, that can be used to store produced fluids recovered from oil and gas wells.

Still another object of the present invention is to provide a storage system incorporating a floating, concrete storage barge having at least one storage compartment.

Still a further object of the present invention is to provide a storage system including a floating, concrete barge and an apparatus for treating produced fluids recovered from earth formations below the body of water in which the storage system is positioned.

Yet another object of the present invention is to provide a method of storing hydrocarbon liquids obtained from earth formations, e.g., oil and gas wells, disposed below a body of water.

The above and other objects of the present invention will become apparent from the drawings, the description given herein, and the appended claims.

The system for storing produced fluids recovered from oil and gas wells according to the present invention comprises a concrete, floating storage barge containing at least one storage compartment, positioning means for positioning the barge at a preselected location in a body of water, and a supply line for delivering produced fluids from a gathering facility to the barge.

In a specific embodiment, the storage system according to the present invention comprises a calm or fixed buoy having a portion floating above the surface of a body of water, the buoy being fixed at a preselected location in the body of water. A concrete storage barge is tethered to the buoy in such a way that the barge can move around the buoy in response to forces exerted by wind or water. A supply line is connected to the buoy and supplies production fluids from a gathering facility spaced from the buoy. A transfer line connectable to the supply line at the buoy transfers produced fluid from the supply line to the barge.

In another specific embodiment of the present invention, the barge is moored in a fixed location by means of anchors or other such mooring apparatus.

In the method according to the present invention, a floating, concrete storage barge is positioned at a preselected location in a body of water. The barge and a source of, or gathering facility for, produced fluids are interconnected, e.g., by a supply line. Produced fluids are transported from the gathering facility to the barge through the supply line.

DESCRIPTION OF THE PREFERRED EMBODIMENTS

The present invention will be described with particular reference to a floating storage facility or system primarily for use in storing produced fluids from offshore, subsea formations, e.g., formations in the Gulf of Mexico, North Sea, etc. However, it is to be understood that the storage system can be used in any body of water, such as inland bays, lakes, or the like.

The term "produced fluid" as used herein means a fluid, primarily a liquid, comprising water and/or hydrocarbons liquids and, in some cases, gases such as $CO_2$, $H_2S$ light hydrocarbons, etc. Generally speaking, produced fluids contain water, the amount of which will vary depending upon the particular well. Conversely, it is possible to obtain produced fluids that are substantially free of water, i.e., crude oil comprised almost entirely of hydrocarbons, e.g., hydrocarbon liquids with and without hydrocarbon and other gases. It will be also be understood that the term "produced fluids" is inclusive of crude oil, as well as hydrocarbon condensates from natural gas wells, stripper liquids, and virtually any other type of naturally occurring hydrocarbon streams, which are typically recovered from producing oil and gas wells.

Thus, a "produced fluid" may be a liquid that is substantially all hydrocarbon in nature, a mixture of such a hydrocarbon liquid and water, or a mixture of such a hydrocarbon liquid, water, and various types of gases.

Figure 1:
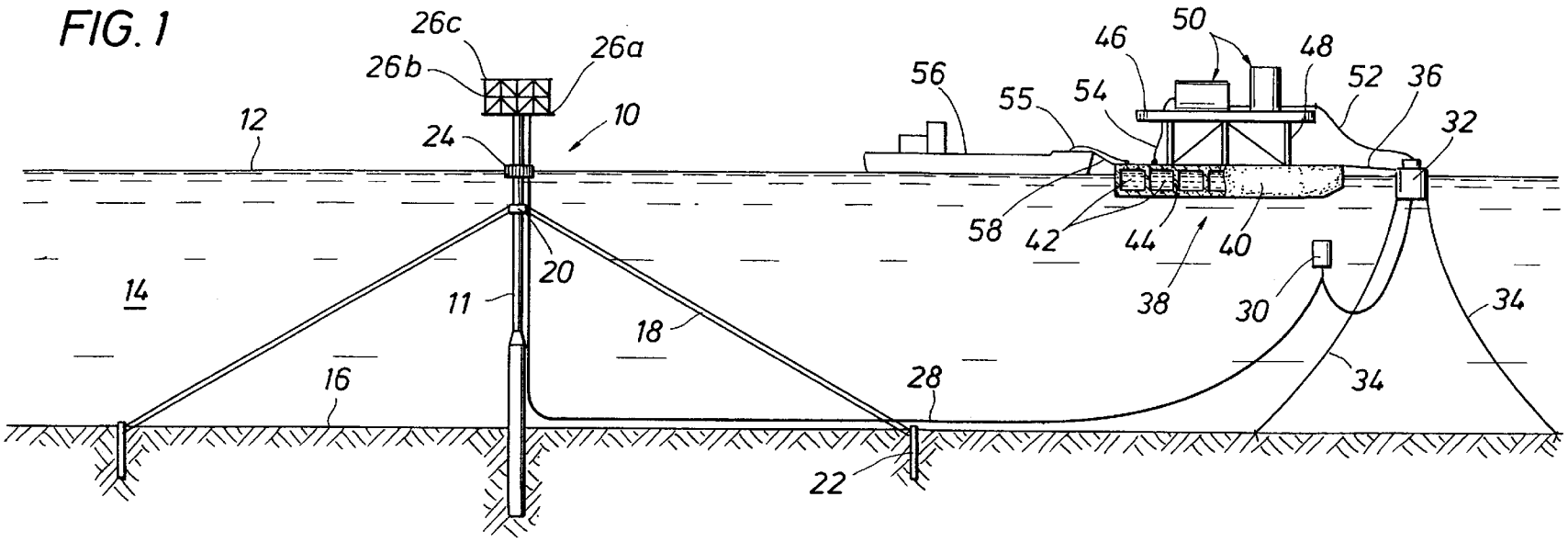
FIG. 1 is an elevational view of one embodiment of the system of the present invention, the floating, storage barge being shown partly in section for clarity.
Figure 2:
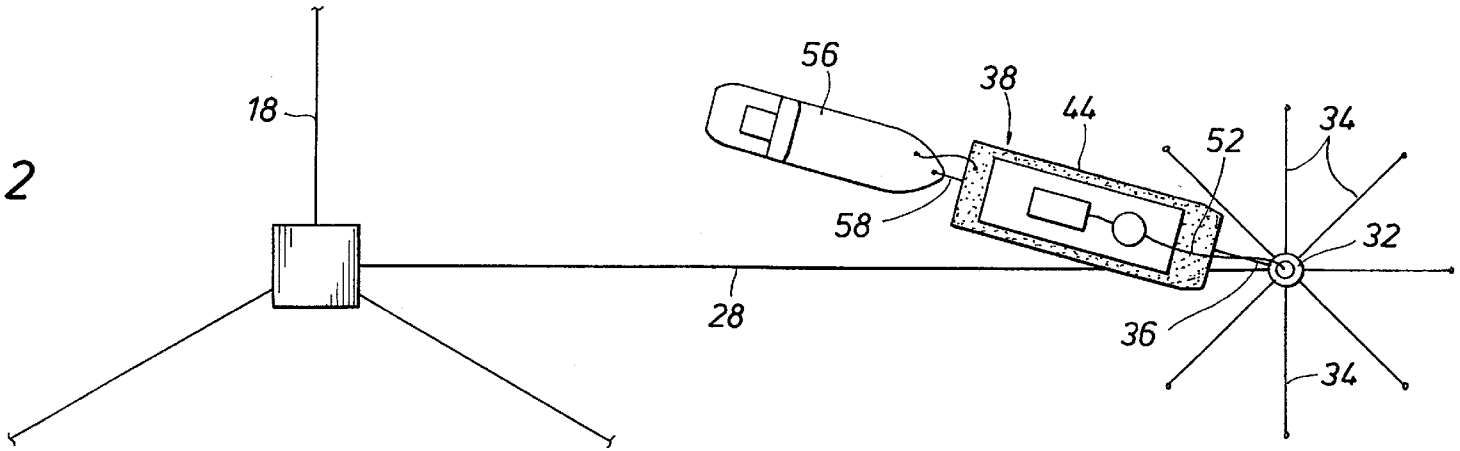
FIG. 2 is a plan view of the system shown in FIG. 1.

With reference then to FIG. 1, there is shown an offshore production platform, shown generally as 10, employing what is commonly referred to as a single caisson 11 and described, for example, in U.S. Pat. Nos. 4,640,647; 4,710,061; and 4,818,146. It will be understood that the system of the present invention is not limited to use with production platforms of the single caisson type but can be used in conjunction with any sort of production platform or other offshore gathering facility wherein produced fluids from underground formations are collected. The single caisson 11 comprises a tubular member that extends from above the surface 12 of the water body 14 to some point below the mud line or bed 16 of the water body 14.

The caisson 11 is stabilized by means of guying cables 18, each cable 18 having one end affixed to a collar 20 that encircles caisson 11, the other end being secured to an anchor piling 22 driven into the seabed 16. Typically, there are three of such guying cables spaced at 120° intervals around caisson 11. The platform 10 can further include a boat landing 24 and a series of decks 26*a, b*, and *c* positioned on the caisson 11 above the sea level 12. It will be appreciated by those skilled in the art that decks 26*a, b*, and *c* of platform 10 can include living quarters for personnel, a heliport, and various drilling, production, and workover equipment typically used in the drilling of, completing of, and producing from oil and gas wells.

In a well-known manner, produced fluid from subterranean formations passes through production tubing (not shown) disposed internally of caisson 11 up to a suitable wellhead assembly located on one of deck 26*a, b*, or *c*. The produced fluid can be treated on platform 10 or flow directly to a supply line 28 that runs from, for example, deck 26*a*, downwardly alongside caisson 11 and across seabed 16 for some distance, and then arcs upwardly to be attached to a submerged suspension buoy 30. The supply line 28 then follows a catenary path from suspension buoy 30 to a calm buoy 32 that is positioned at some preselected location spaced from production platform 10, buoy 32 being held in position by a plurality (generally six) of catenary legs or cables 34. As is usual in the case of buoys, catenary legs 34 are anchored in a suitable fashion to seabed 16. It will thus be seen that partially submerged suspension buoy 30 serves the purpose of accommodating movement and flexure in supply line 28 between production platform 10 and buoy 32. Buoy 32 is only partially submerged, a portion of buoy 32 extending above the surface 12 of water 14.

Tethered to buoy 32 by a tether line 36 is a concrete barge shown generally as 38. The tethering of barge 38 to buoy 32 by tether line 36 is such as to allow barge 38 to move in a fashion commonly referred to as "weather vaning" about buoy 32. In other words, barge 38 is attached to buoy 32 by a swivel assembly (not shown) and thus can move around buoy 32 in response to forces acting on barge 32 due to wind and water, e.g., waves, current, etc.

As noted, barge 38 is of concrete construction, albeit that it may include internal steel reinforcement or other structural steel members. However, the outer shell 40, including the bottom, deck, and side surfaces of barge 38, is substantially all concrete to enhance resistance to weathering and to prevent, to the extent possible, exposure of such steel reinforcement or structural members. Barge 38 is provided with a series of compartments 42 generally separated from one another by suitable partitions 44, compartments 42 being laid out in a honeycomb fashion in barge 38. While barge 38 and storage compartments 42 can be, within reason, virtually any size, typically barge 38 will be approximately from 25 to 600 feet long, from 90 to 140 feet wide, and from 40 to 60 feet deep. The barge can have a storage capacity of from 20,000 to 3000,000 barrels of liquid. As seen in co-pending Application Ser. No. 08/763,326, entitled, "Offshore Production and Storage Facility," naming Conrad J. Blanchard and Frank L. Anastasio as inventors and filed contemporaneously herewith, barge 38 can consist of suitable piping, valving, and pumps to facilitate the filling and emptying of compartments 42 and to accomplish adequate ballasting and trim of barge 38.

Mounted on the deck 44 of barge 38 is an elevated platform 46, platform 46 being elevated above deck 44 and supported by a suitable framework 48 attached to deck 46 of barge 38. Platform 46 serves as a support for hydrocarbon processing apparatus, shown generally as 50, such as gas gathering equipment, water removal equipment, filters, etc., such apparatus being well known to those skilled in the art. Supply line 28 is interconnected to transfer line 52 at buoy 32 and to barge 38. Accordingly, produced fluid can be transferred from supply line 28 to transfer line 52 and thence to barge 38. As shown, transfer line 52 is connected to hydrocarbon processing apparatus 50. Once processed in apparatus 50 to remove water, if any is present, the dewatered product, e.g., hydrocarbon liquid, is transferred via line 54 to storage compartments 42 in a systematic fashion to ensure proper ballasting and trim of barge 35. It will thus be seen that produced fluid from production wells can be temporarily stored in barge 38 until such time as barge 38 is full, at which point the product in barge 38 can be off-loaded to a tanker or other suitable hydrocarbonliquid-carrying marine vessel.

To off-load or empty product from barge 38, a tanker or another suitable marine transport vessel used to carry liquid hydrocarbons is tied up to the stern of barge 38 via a line 58. By means of suitable pumps (not shown), liquid hydrocarbon is pumped from compartments 42 of barge 38 via a line 55 into tanker 56. It will be understood that compartments 42 are emptied in such a fashion so as to maintain proper ballasting and trim of barge 38. Tanker 56 is then released from barge 38 and, being a powered vessel, can back away from barge 38 and carry the product removed therefrom to suitable onshore facilities, e.g., a refinery.

Figure 3:
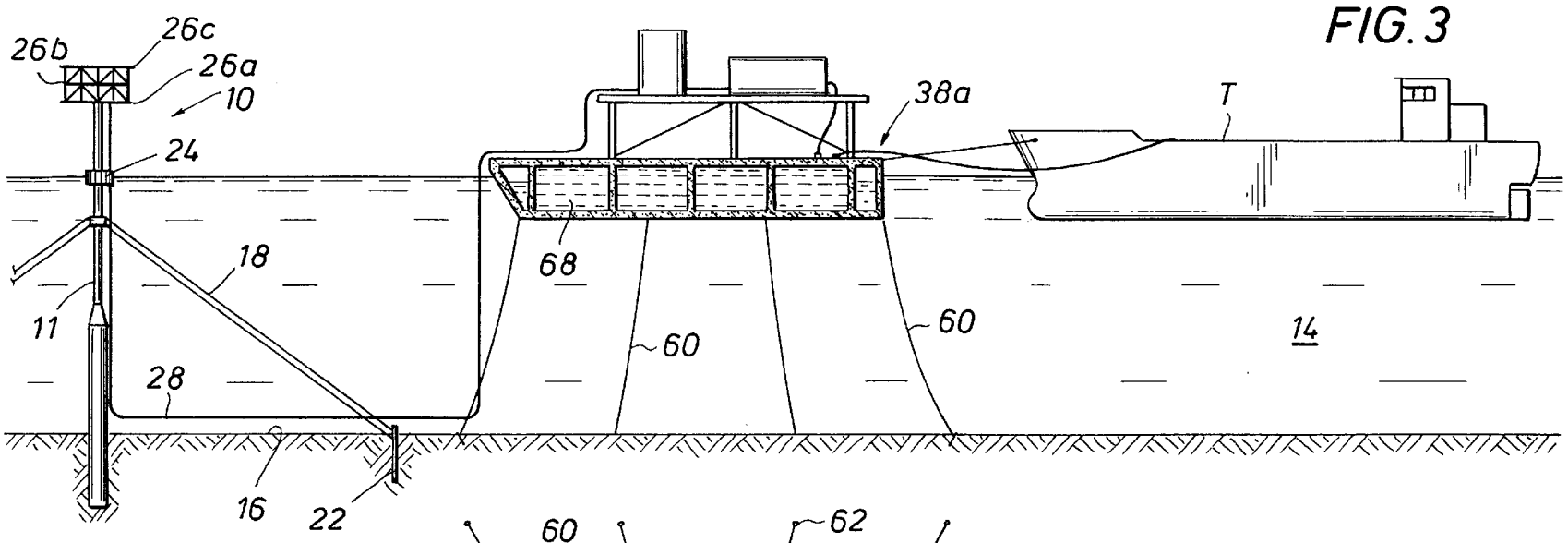
FIG. 3 is a partial elevational view of another embodiment of the system of the present invention.
Figure 4:
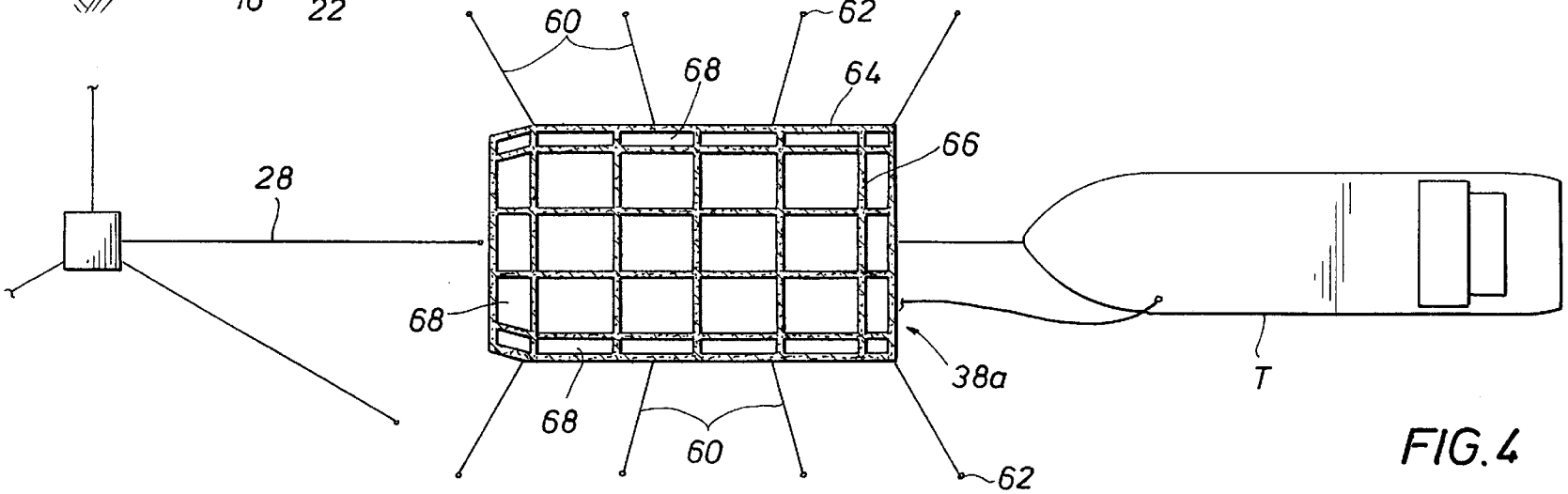
FIG. 4 is a plan view of the system shown in FIG. 3.

With reference now to FIGS. 3 and 4, there is shown another embodiment of the present invention wherein the barge 38*a*, rather than being tethered to the fixed buoy 32 so that it can "weather vane" about the buoy, is substantially fixed in position. To accomplish this, barge 38*a* is provided with an anchoring system comprised of anchor lines 60 connected to anchors 62 that effectively hold barge 38 in a fixed position. Mooring or anchoring systems that can maintain a floating vessel, such as the barge of the present invention, in a fixed position while accommodating for wave action, tidal changes, etc., are well known to those skilled in the art. When the system of the present invention employs the moored barge 38 as described above, off-loading of produced fluids from the barge to a transporter vessels would generally be accomplished by a dynamically positioned transport vessel T so as to maintain the transport vessel in a fixed position relative to the fixed barge position.

FIGS. 3 and 4 show a preferred embodiment of the barge used in the system of the present invention. Barge 38*a*, as shown in FIGS. 3 and 4, is generally of double-wall construction being provided with an outer wall 64 around the perimeter of the barge and an inner wall 66 also around the perimeter of the barge, but displaced inwardly from wall 64. Walls 64 and 66 thus essentially define a double-hulled vessel. The space between walls 64 and 66 is preferably divided into a series of ballast or trim compartments 68 that can alternately be filled with seawater or emptied, as the case may be, to maintain proper ballasting of the barge 38*a*. Additionally, depending on which of the ballast compartments 68 are involved, filling or emptying can be used to trim barge 38*a* to the extent desired. This double-hulled construction of barge 38*a* is an important feature of the system of the present invention since it effectively provides an inexpensive, double-hulled, floating container, greatly minimizing the chance of an oil spill should there be a collision between a seagoing vessel and barge 38*a*. In other words, a rupture of wall 64, at any given location, would only result in the ingress or egress of seawater into or out of compartments 68, whereas the produced fluids (oil) in the compartments 42*a* would remain confined and not be released into the sea.

This double-wall or double-hull construction of barge 38*a*, as described above, brings into focus the unobvious advantages of using a concrete barge of the type under consideration in an offshore storage facility. As opposed to steel, which has an effective life of 12–15 years, concrete offers a fatigue life of 30 years. Additionally, it is also more fire-retardant than steel. Further, and as described above, it provides an economical solution to the problem of double-hull construction in oil storage and transportation vehicles, which greatly minimizes the chance of oil pollution due to an at-sea collision. The perimeter compartments formed between the inner and outer side walls of the barge perform the dual function of permitting ballasting and trim while also serving as a safety system to prevent escape of oil or other produced hydrocarbons from the barge should a collision or other type of impact occur.

It will be appreciated that the apparatus and method of the present invention is quite useful in shallow water, where small transfer vessels such as tanker 56 can be used to transfer the liquid hydrocarbon from barge 38 to onshore processing facilities or, if desired, to larger tankers that cannot navigate in shallow waters. In this regard, barge 38 can be a shallow draft container, e.g., drawing less than about ten feet of water.

The foregoing description and examples illustrate selected embodiments of the present invention. In light thereof, variations and modifications will be suggested to one skilled in the art, all of which are in the spirit and purview of this invention.

What is claimed is:

1. A system for storing produced fluids recovered from oil and gas wells at a gathering facility, comprising:

a concrete, floating storage barge comprising a peripheral wall structure, said peripheral wall structure including a peripheral, inner wall and a peripheral outer wall, said inner wall at least partially defining at least one enclosed storage compartment, said inner wall and said outer wall being laterally spaced and defining at least one ballast compartment therebetween;

means for selectively introducing or removing water into or from said ballast compartment;

positioning means for positioning said barge at a preselected location in a body of water; and a supply line for delivering said produced fluids from said gathering facility to said barge.

2. The system of claim 1 wherein said positioning means comprises a fixed buoy and a tether line interconnecting said buoy and said barge whereby said barge is free to move in a path generally around said buoy in response to forces exerted by wind or water.

3. The system of claim 2 wherein said supply line comprises a first portion connecting said gathering facility to said buoy and a second portion connecting said buoy to said barge.

4. The system of claim 1 wherein said storage barge includes apparatus for separating water from said produced fluids to produce a substantially water-free, hydrocarbon product for storage in said storage compartment.

5. The system of claim 4 wherein said barge comprises a top deck and said apparatus for separating water from said produced fluids is positioned on a platform attached to and spaced upwardly from said top deck of said barge.

6. The system of claim 1 including a production platform spaced from said barge, said produced fluid being gathered at said production platform, said supply line for said produced fluid being connected to said production platform.

7. The system of claim 1 wherein said barge comprises a plurality of individual storage compartments.

8. The system of claim 7 wherein said storage compartments are arranged in a honeycomb fashion.

9. The system of claim 1 wherein said positioning means comprises anchoring means to moor said barge in a substantially fixed position.

10. The system of claim 1 wherein there are a plurality of said ballast compartments formed in said peripheral wall structure between said inner and outer walls.

* * * * *